US007306470B1

(12) United States Patent
Johnson

(10) Patent No.: US 7,306,470 B1
(45) Date of Patent: Dec. 11, 2007

(54) GUARD AND ELECTRICAL ENCLOSURE EMPLOYING THE SAME

(75) Inventor: Jeffrey L. Johnson, Lincoln, IL (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/532,614

(22) Filed: Sep. 18, 2006

(51) Int. Cl.
*H01R 13/44* (2006.01)

(52) U.S. Cl. ..... 439/136

(58) Field of Classification Search ..... 439/136, 439/147; 379/440, 451; 174/50, 66, 53; 200/43.11; 206/521; 349/58; D13/177
See application file for complete search history.

(56) References Cited

U.S. PATENT DOCUMENTS 1,935,565 A * 11/1933 Goetselman ..... 220/3.4
2,204,006 A * 6/1940 Allen et al. ..... 220/3.4
2,997,520 A * 8/1961 Kinsman ..... 174/67
3,204,807 A * 9/1965 Ramsing ..... 220/242
3,601,276 A * 8/1971 Culpepper ..... 220/3.4
D324,816 S * 3/1992 LeDuc ..... D8/353
5,621,192 A * 4/1997 Bordwell et al. ..... 174/67
6,621,004 B2 * 9/2003 Cheynet et al. ..... 174/50
6,683,248 B2 * 1/2004 Vrame et al. ..... 174/50
6,765,145 B2 * 7/2004 Cheynet et al. ..... 174/50
6,949,708 B1 * 9/2005 Hausen et al. ..... 174/66

OTHER PUBLICATIONS

ITW Fastex, "Formex GK Product Data/Flame Retardant Polypropylene Sheet," Rev 2/94, Formex Manufacturing, Inc., Lawrenceville, GA.

* cited by examiner

*Primary Examiner*—Alexander Gilman
(74) *Attorney, Agent, or Firm*—Martin J. Moran

(57) ABSTRACT

A guard is provided for an electrical enclosure including a panel assembly coupled to the housing of the electrical enclosure and having a first securing mechanism at or about the first side of the panel assembly, and a second securing mechanism disposed at or about the second side of the panel assembly a distance from the first securing mechanism. The first and second securing mechanisms are structured to receive and secure a number of electrical components. The guard includes a shield member having first and second ends structured to be coupled to the first and second securing mechanisms of the panel assembly, an intermediate portion extending therebetween, and at least one pull tab to facilitate removal of the guard. When installed on the panel assembly, the shield member forms a protective arc which overlays and shields at least some of the electrical components from being undesirably painted or otherwise coated.

21 Claims, 4 Drawing Sheets

210
204
226
200
224
222
208
202
228
206
212
214

210
204
226
214
222
224
228
208
200
206
238

GUARD AND ELECTRICAL ENCLOSURE EMPLOYING THE SAME

BACKGROUND OF THE INVENTION

1. Field of the Invention

The invention relates generally to enclosures and, more particularly, to guards for shielding the components of electrical enclosures when the electrical enclosures and/or their surroundings, are being covered with a coating, such as paint. The invention also relates to electrical enclosures which employ guards.

2. Background Information

Electrical equipment such as, for example, relays, circuit breakers, electric meters and transformers, are typically housed within an enclosure such as, for example, a housing, such as a box or cabinet, to protect the electrical equipment. Such enclosures can be employed, for example and without limitation, indoors on the surface of a wall or within a prepared opening in the wall, or outdoors on an exterior wall of a building. Regardless of where the electrical enclosure is employed, it is often desirable to paint or otherwise cover the electrical enclosure and/or its surroundings (e.g., without limitation, the walls of a building) with a suitable coating (e.g., without limitation, powder coating; stucco; plaster). Such covering can be undertaken to improve the visual appearance of the enclosure and its surroundings, for example, by helping to "blend in" the enclosure with the wall or other structure on which it is mounted. It can also serve to provide a protective coating, for example, to resist rusting of the electrical enclosure.

FIG. 1 shows an example of an electrical enclosure which is a meter cabinet 2. The meter cabinet 2 is mounted on a wall 3 (partially shown), and generally comprises a housing 4 having opposing sides 6,8, a back panel 10 extending between the sides 6,8, a bottom 12, and a top 14. The sides 6,8, bottom 12, and top 14, have flanges 16,18,20,22 (shown in hidden line drawing), which extend respectively therefrom. The flanges 16,18,20,22 are nailed or otherwise suitably coupled to the wall 3 in order to secure the cabinet 2 in the desired position with respect thereto.

As shown in FIGS. 1 and 2, a panel assembly 24 of the cabinet 2 (FIG. 1) includes at least one bus bar 26 (two bus bars 26 are shown). The bus bars 26 are electrically connected to the meter socket 28 of the cabinet 2, as shown in FIG. 1, and are supported on a panel 30 of the panel assembly 24 by a bus bar support insulator 32. Switchgear, such as the circuit breaker 34 shown, can be electrically connected to the bus bar 26 at or about electrically conductive stabs 36 which extend outwardly from the bus bar 26, as best shown in FIG. 2. The circuit breaker 34 is held in place on the panel 30, at least in part, by panel teeth 38, which generally extend inward from the opposing sides of the panel 30 and engage a recess 40 at or about the base of the circuit breaker 34, as shown in FIG. 2.

Contractors who install electrical distribution products, such as the aforementioned meter cabinet 2, sometimes paint or otherwise coat the cabinet 2 and/or the building or other surrounding structures with the cabinet 2 installed (e.g., coupled to the wall 3), and with the cover (not shown) of the cabinet 2 removed (see FIG. 1). The exposed electrical components (e.g., without limitation, bus bar 26; bus bar support insulator 32; electrically conductive stabs 36) of the cabinet 2 are susceptible to being at least partially undesirably covered, for example, by over spray associated with a painting process, which can significantly inhibit the performance of the electrical components.

In an attempt to avoid undesired painting or other covering of the electrical components, a wide variety of materials such as, for example and without limitation, cardboard and paper, have been temporarily and somewhat arbitrarily employed. However, such materials are flimsy and tend not to stay in place, particularly when subjected to the forces associated with, for example, spray painting. These materials are also generally not reusable. Moreover, they must be trimmed and or taped, glued or otherwise secured to the cabinet in order to sufficiently cover the electrical components. This undesirably adds time and expense to the painting process, and can leave an undesirable residue (e.g., without limitation, sticky glue residue).

It has also been known to employ covers on electrical enclosures for reasons entirely unrelated to the protection of electrical components from being unintentionally painted or otherwise coated. For example, shields made from electrically insulative materials (e.g., without limitation, rubber) have been known to be installed over live electrical components of electrical enclosures in order to prevent workers who are working in the vicinity of the enclosure from accidentally coming into contact with the live electrical components. However, among other disadvantages, such covers are sometimes difficult to remove, tending to become undesirably bound with the panel teeth of the enclosure panel assembly. Additionally, materials which might serve well as electrical insulators are often not particularly well adapted for use as a low cost solution for shielding electrical components from painting or coating. For example, many electrically insulative materials are relatively flimsy and would, therefore, be likely to be displaced by the forces associated with spray painting. Electrically insulative materials may also be more costly than desired.

There is a need, therefore, for a guard for electrical enclosures which effectively shields and protects electrical components of the electrical enclosure after a minimal amount of installation effort and time, and which can be reused.

There is, therefore, room for improvement in guards for electrical enclosures.

SUMMARY OF THE INVENTION

These needs and others are met by embodiments of the invention, which are directed to a guard for shielding the electrical components of an electrical enclosure when the electrical enclosure and/or surrounding structures is/are being painted or otherwise covered with a known or suitable coating (e.g., without limitation, powder coating; stucco; plaster).

As one aspect of the invention, an electrical enclosure comprises: a housing structured to house a number of electrical components; a panel assembly coupled to the housing and including a first side and a second side; a first securing mechanism disposed at or about the first side of the panel assembly and being structured to receive and secure a number of electrical components; a second securing mechanism disposed at or about the second side of the panel assembly, spaced a distance from the first securing mechanism and being structured to receive and secure a number of electrical components; and a guard comprising: at least one shield member including a first end, a second end and an intermediate portion extending between the first end and the second end, and at least one pull tab disposed at or about a corresponding one of the first end of such shield member and the second end of such shield member, in order to facilitate removal of such shield member from the panel assembly.

When the electrical enclosure and/or a structure proximate the electrical enclosure is/are being coated, such shield member is installed on the panel assembly of the electrical enclosure in order to shield the panel assembly and a number of electrical components housed by the housing of the electrical enclosure from being undesirably coated. When such shield member is not installed on the panel assembly, it may be substantially flat and includes a width which is greater than the distance between the first securing mechanism of the panel assembly and the second securing mechanism of the panel assembly. When such shield member is installed on the panel assembly, the first end of such shield member and the second end of such shield member engage the first securing mechanism and the second securing mechanism of the first side and the second side of the panel assembly, respectively, resulting in the intermediate portion of such shield member forming a protective arc which overlays and shields the at least some of the electrical components housed by the housing of the electrical enclosure.

The first securing mechanism and the second securing mechanism may be a first plurality of teeth extending from the first side of the panel assembly, and a second plurality of teeth extending from the second side of the panel assembly, respectively, wherein when the shield member is installed on the panel assembly of the electrical enclosure, the first end of the shield member and the second end of the shield member engage the first plurality of teeth of the panel assembly and the second plurality of teeth of the panel assembly, respectively. The pull tab of the guard may comprise an extension of one of the first and second ends of the shield member. When each shield member is installed on the panel assembly, the extension may extend from the corresponding one of the first and second ends of the shield member between an adjacent pair of the teeth of a corresponding one of the first and second sides of the panel assembly. Alternatively the guard may include a first pull tab disposed at or about the first end of the shield member, and a second pull tab disposed at or about the second end of the shield member. The extension(s) and the shield member may be one continuous piece of material.

The shield member may comprise one of: (a) a plurality of separate shield members installed on the panel assembly at locations where shielding from unintentional coating is desired, and (b) one single-piece shield member which shields and protects substantially all of the panel assembly.

As another aspect of the invention, a guard is provided for an electrical enclosure including a housing, a number of electrical components housed by the housing, and a panel assembly coupled to the housing and including a first side and a second side. The panel assembly includes a first securing mechanism disposed at or about the first side of the panel assembly and being structured to receive and secure a number of electrical components, and a second securing mechanism disposed at or about the second side of the panel assembly, spaced a distance from the first securing mechanism and being structured to receive and secure a number of electrical components. The guard comprises: a shield member including a first end structured to be coupled to the first securing mechanism of the panel assembly, a second end structured to be coupled to the second securing mechanism of the panel assembly, and an intermediate portion extending between the first end of the shield member and the second end of the shield member; and at least one pull tab disposed at or about a corresponding one of the first end of the shield member and the second end of the shield member, in order to facilitate removal of the shield member from the panel assembly. The shield member is structured to be installed on the panel assembly of the electrical enclosure in order to shield the panel assembly and a number of electrical components housed by the housing of the electrical enclosure from being undesirably coated when at least one of the electrical enclosure and a structure proximate the electrical enclosure is being coated. When the shield member is not installed on the panel assembly the shield member may be substantially flat and includes a width which is greater than the distance between the first securing mechanism of the panel assembly and the second securing mechanism of the panel assembly. When the shield member is installed on the panel assembly, the first end of the shield member and the second end of the shield member are structured to engage the first securing mechanism and the second securing mechanism of the first side and the second side of the panel assembly, respectively, resulting in the intermediate portion of the shield member forming a protective arc which overlays and shields the at least some of the electrical components housed by the housing of the electrical enclosure.

The shield member may be made from a tear-resistant material, and may have a thickness ranging from about 0.08 inch to about 0.02 inch. The shield member may alternatively be made from an electrically insulative material and be installed on the electrical enclosure in order to provide insulation of the electrical components housed by the electrical enclosure.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
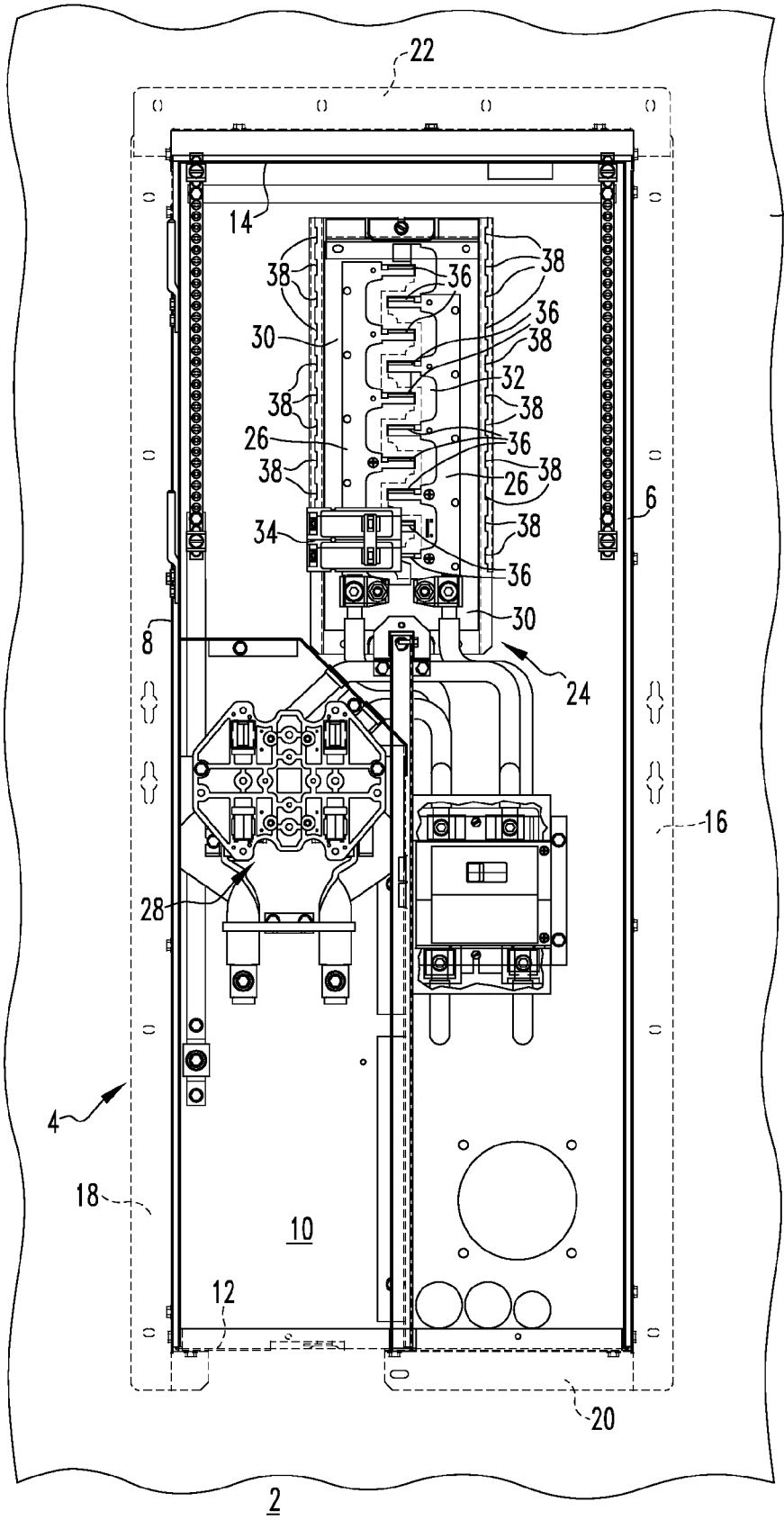
FIG.1 PRIOR ART
FIG. 1 is a vertical elevation view of a meter cabinet with the meter and the cover of the cabinet removed to show internal structures.

For purposes of illustration, embodiments of the invention will be described as applied to paint guards for shielding electrical equipment housed within a meter cabinet when the meter cabinet and/or structures proximate the meter cabinet are being painted, although it will become apparent that they could also be applied to shield a wide variety of components when, for example, painting or applying any other known or suitable coating (e.g., without limitation, powder coating; stucco; plaster) directly to or in the vicinity of any known or suitable type of enclosure, including electrical enclosures other than meter cabinets, such as, for example and without limitation, panel boards, switchgear cabinets, and load centers.

Directional phrases used herein, such as, for example, left, right, front, back, top, bottom and derivatives thereof, relate to the orientation of the elements shown in the drawings and are not limiting upon the claims unless expressly recited therein.

As employed herein, the term "pull tab" refers to any known or suitable portion or mechanism which is coupled to or which is an integral part of the guard of the invention, in order to facilitate removal of the guard, for example, after the electrical enclosure or structures proximate the electrical enclosure have been painted or otherwise coated, and expressly includes, without limitation, protrusions or extensions of the guard, and tabs, strings, or any other known or suitable component coupled to and/or extending from the guard to facilitate removal thereof.

As employed herein, the term "fastener" refers to any known or suitable connecting, securing or tightening material or mechanism and expressly includes, but is not limited to, screws, bolts and the combinations of bolts and nuts (e.g., without limitation, lock nuts) and bolts, washers and nuts, as wells as adhesive materials, such as glue and tape.

As employed herein, the statement that two or more parts are "coupled" together shall mean that the parts are joined together either directly or joined through one or more intermediate parts.

As employed herein, the term "number" shall mean one or an integer greater than one (i.e., a plurality).

As employed herein, the term "integral" refers to a unitary feature which comprises one single and continuous piece of material as opposed to a conglomeration of components which are originally separate, but which are subsequently coupled together.

Figure 3:
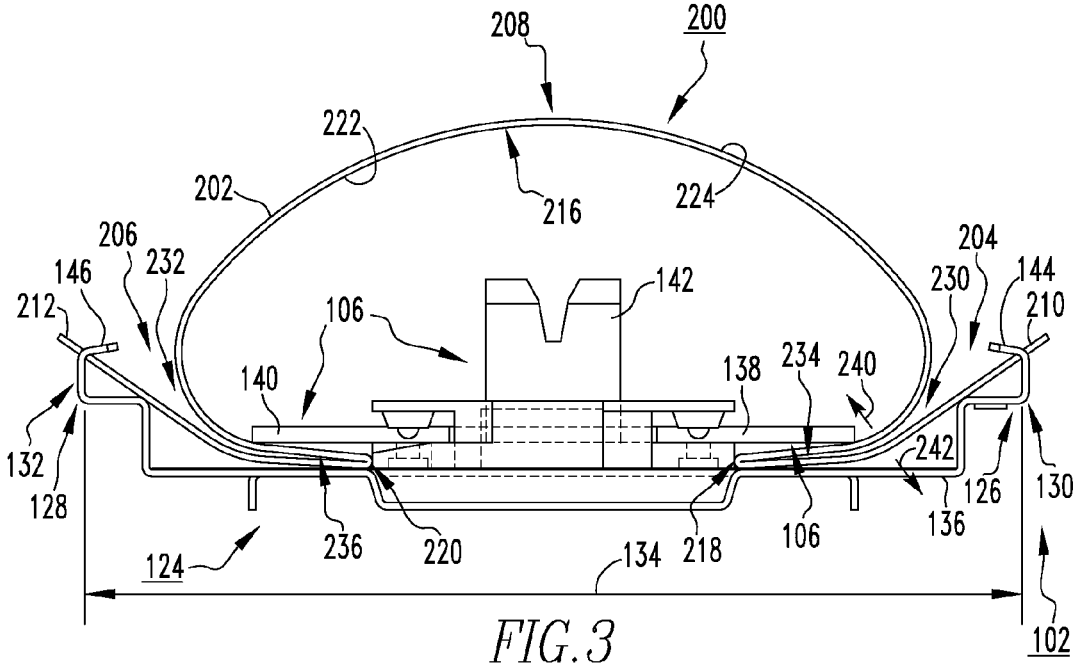
FIG. 3 is a bottom plan view of a panel assembly for an electrical enclosure, shown employing a guard in accordance with an embodiment of the invention.
Figure 4:
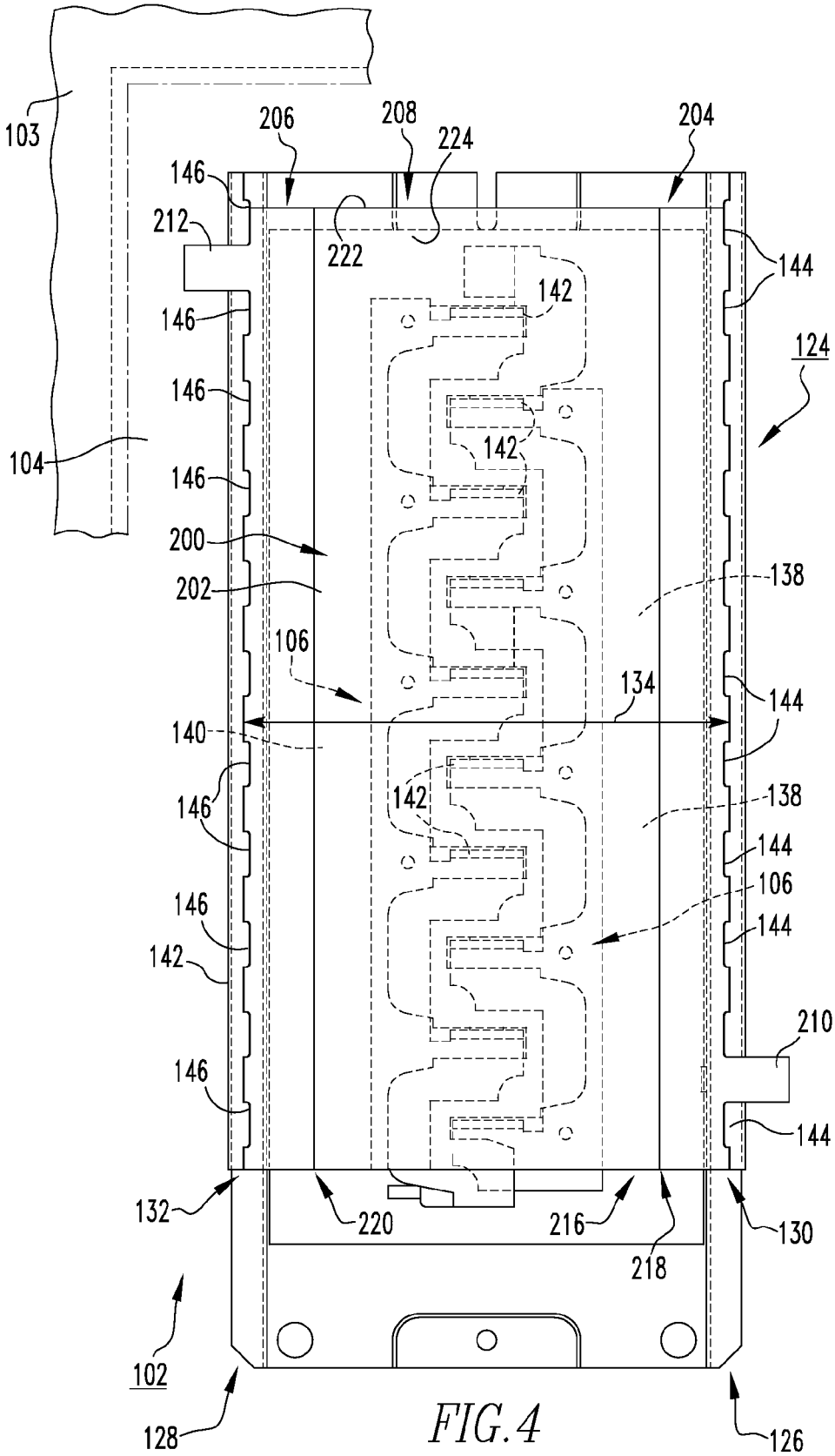
FIG. 4 is a vertical elevation view of the panel assembly and guard therefor of FIG. 3.

FIGS. 3 and 4 show portions of an electrical enclosure, such as a meter cabinet 102, employing a guard 200. For example, the guard 200 is installed on the meter cabinet 102 to shield, for example, a number of electrical components 106 of the meter cabinet 102, when the meter cabinet 102 and/or a structure, such as wall 103 (partially shown in simplified form in FIG. 4), which is proximate the meter cabinet 102, is/are being coated, for example and without limitation, by a liquid coating, such as paint or lacquer, or a semi-solid or solid coating, such as, for example, powder coating, plaster, or stucco. The guard 200 could alternatively be made of a suitable electrically insulative material and be installed on the electrical enclosure 102 to provide insulation of the electrical components 106 housed by the enclosure 102.

Figure 2:
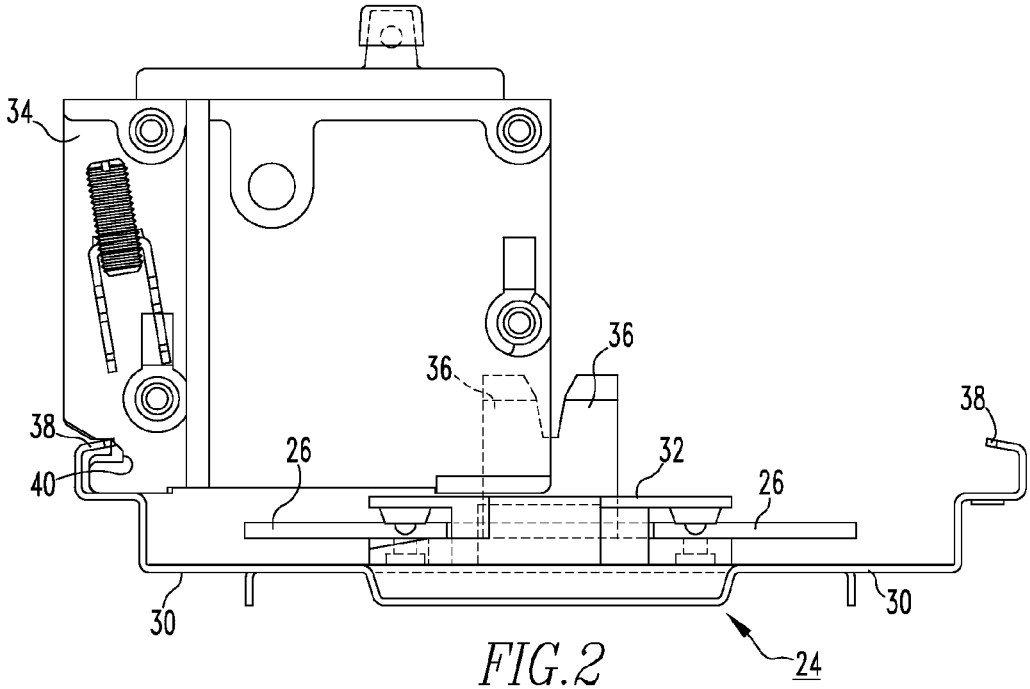
FIG.2 PRIOR ART
FIG. 2 is a bottom plan view of the panel assembly for the meter cabinet of FIG. 1.

More specifically, the meter cabinet 102 includes a housing 104 (partially shown in FIG. 4) which is structured to house a number of electrical components 106 (e.g., without limitation, electrical bus bars 138,140, electrically conductive stabs 142, and/or any other known or suitable electrical component), and a panel assembly 124 coupled to the housing 104. The panel assembly 124 includes a first side 126 and a second side 128. A first securing mechanism 130 is disposed at or about the first side 126 of the panel assembly 124, and is structured to receive and secure a number of the electrical components 106. A second securing mechanism 132 is disposed at or about the second side 128 of the panel assembly 124, spaced a distance 134 from the first securing mechanism 130, as shown, and is also structured to receive and secure a number of electrical components 106 (see, for example, circuit breaker 34 being secured by teeth 38 of panel member 30 of FIG. 2, which, except for the guard 200, is substantially similar to panel member 124).

The guard 200, which is shown in FIGS. 3, 4, 5A and 5B, includes at least one shield member 202. Each shield member 202 has a first end 204, a second end 206, and an intermediate portion 208 extending therebetween. At least one pull tab 210,212 is disposed at or about a corresponding one of the first and second ends 204,206 of the shield member 202, in order to facilitate removal of the shield member 202 from the panel assembly 124.

Figures 5A, 5B:
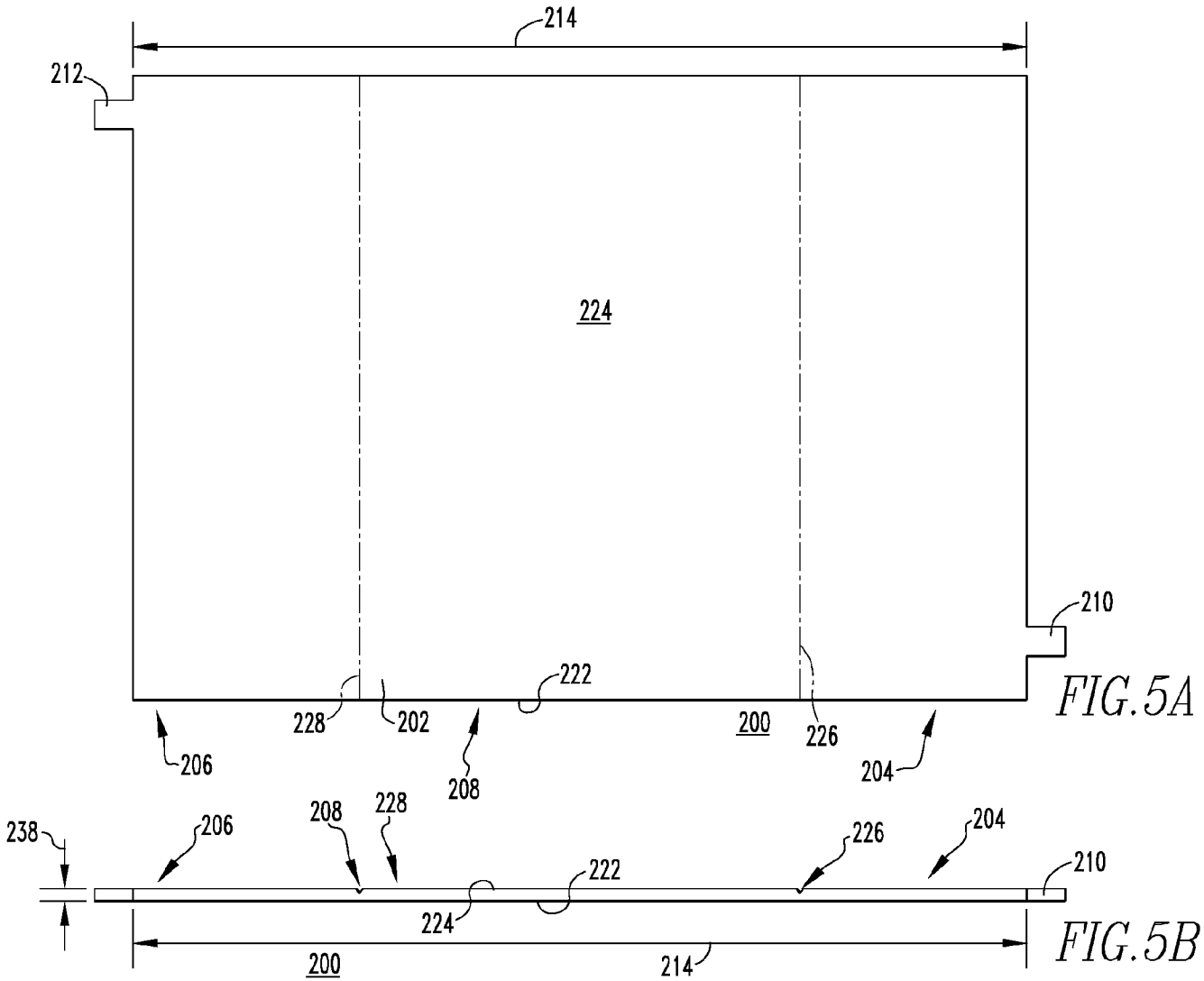
FIGS. 5A and 5B are vertical elevation and bottom plan views, respectively, of the guard of FIG. 4 before being folded for installation on the panel assembly.

When the shield member 202 is not installed on the panel assembly 124, as shown in FIGS. 5A and 5B, it is substantially flat and includes a width 214 which is greater than the aforementioned distance 134 (FIGS. 3 and 4) between the first and second securing mechanisms 130,132 (FIGS. 3 and 4) of the panel assembly 124 (FIGS. 3 and 4) of the meter cabinet 102 (FIG. 4). Accordingly, as best shown in FIG. 3, when the shield member 202 is installed on the panel assembly 124, the first and second shield member ends 204,206 engage the first and second securing mechanisms 130,132 of the first and second panel assembly sides 126, 128, respectively, resulting in the intermediate portion 208 of the shield member 202 forming a protective arc 216. The protective arc 216 overlays and shields at least some of the electrical components 106 which are housed by the housing 104 (FIG. 4) of the meter cabinet 102. It will be appreciated that although the example guard 200 shown and described herein comprises one single-piece shield member 202, which shields and protects substantially all of the panel assembly 124 of the meter cabinet 102, that the guard 200 could alternatively comprise a plurality of smaller, separate shield members (not shown) installed on the panel assembly 124 at various locations where shielding from unintentional coating is desired.

Continuing to refer to FIGS. 3 and 4, the panel assembly 124 comprises a panel member 136 and first and second electrical bus bars 138,140 which are coupled to the panel member 136 proximate the first and second securing mechanisms 130,132, respectively. When the shield member 202 is installed on the panel assembly 124 of the meter cabinet 102, the shield member 202 includes a first bend 218 (best shown in FIG. 3) between the first end 204 and the protective arc 216 of the shield member 202, and a second bend 220 (best shown in FIG. 3) between the first end 206 and protective arc 216 of the shield member 202. The first and second bends 218,220 are disposed between the first and second electrical bus bars 138,140 and a corresponding portion of the panel member 136, respectively, thereby securing the shield member 202 to the panel assembly 124, as shown.

More specifically, a first portion 230 of the shield member 202, between the first bend 218 and the first end 204 of the shield member 202, doubles back on itself, thereby forming a first double thickness 234, and a second portion 232 of the shield member 202, between the second bend 220 and the second end 206 of the shield member 202, doubles back on itself, thereby forming a second double thickness 236, as shown in FIG. 3. The first double thickness 234 of the first portion 230 of shield member 202 biases the first end 204 thereof generally outward in opposite directions, as indicated by arrows 240 and 242 of FIG. 3. Specifically, the first double thickness 234 biases the upper (from the perspective of FIG. 3) portion of the first double thickness 234 in the direction of arrow 240, toward the first electrical bus bar 138 of the panel assembly 124, and simultaneously biases the lower (from the perspective of FIG. 3) portion of the first double thickness 234 in the direction of arrow 242, toward the panel member 136, as shown. In this manner, the first end 204 of the shield member 202 is secured (e.g., wedged) within the first securing mechanism 130 of the panel assembly 124 and beneath (from the perspective of FIG. 3) the first electrical bus bar 138 of the panel assembly 124. The second side 206 of the shield member 202 is biased by the second double thickness 236 in substantially the same manner, in order to secure (e.g., wedge) the first end 206 of the shield member 202 both within the second securing mechanism 132 of the panel assembly 124, and beneath (from the perspective of FIG. 3) the second electrical bus bar 140 of the panel assembly 124, as shown. In this manner, it is assured that the shield member 202 will be sufficiently secure, for example, to withstand the forces or pressures commonly associated with spray painting or any other known or suitable coating process.

Each shield member 202 of the guard 200 also has an interior surface 222 which, when installed on the panel assembly 124, faces toward at least some of the electrical components 106 (FIGS. 3 and 4) of the meter cabinet 102 (FIGS. 3 and 4), and an exterior surface 224 generally opposite the interior surface 222. Also, as shown in FIGS. 5A and 5B, the example shield member 202 includes a first score 226 (e.g., groove; channel; recess; area of reduced material thickness) and a second score 228 in at least one of the interior surface 222 (FIG. 3) and the exterior surface 224 of the shield member 202, in order to facilitate bending of the shield member 202 to form the first and second bends 218,220 (best shown in FIG. 3). It will, however, be appreciated that any suitable number and configuration of scores or other suitable structure or mechanism for facilitating bending of the shield member 202, could be employed without departing from the scope of the invention. It will also be appreciated that although the first and second scores 226,228, which are shown in FIGS. 5A and 5B, are disposed in the exterior surface 224 of the shield member 202, that they could alternatively, or additionally, be employed in the interior surface 222. It will further be appreciated that no such score lines are required.

The first and second securing mechanisms 130,132 of the example panel assembly 124 comprise a first plurality of teeth 144 extending from the first side 126 of the panel assembly 124, and a second plurality of teeth 146 extending from the second side 128 of the panel assembly 124, respectively, as best shown in FIG. 4. Thus, when the shield member 202 is installed on the panel assembly 124 of the meter cabinet 102, the first end 204 of the shield member 202 and the second end 206 of the shield member 202 engage the teeth 144,146, respectively. It will, however, be appreciated that the guard 200 and shield member(s) 202 could be employed with any known or suitable alternative securing mechanism(s) (not shown) other than the first and second securing mechanisms 130,132 and teeth 144,146 thereof, which are shown and described herein.

As illustrated in FIGS. 3, 4, 5A and 5B, the aforementioned pull tabs 210,212 of the example shield member 202 comprise extensions 210,212 of the first and second ends 204,206, respectively, of the shield member 202. More specifically, as best shown in FIG. 4, when the shield member 202 is installed on the panel assembly 124, the extensions 210,212 extend from the first and second ends 204,206 of the shield member 202 between an adjacent pair of teeth 144 of the first side 126 of the panel assembly 124, and an adjacent pair of teeth 146 of the second side 128 of the panel assembly 124, respectively. Preferably, the pull tab extensions 210,212 and the shield member 202 comprise one continuous piece of material. It will, however, be appreciated that the pull tabs 210,212 could alternatively be made from a separate piece of material (not shown) or comprise a separate mechanism (not shown) which is coupled to the shield member 202 to facilitate removal thereof. It will also be appreciated that any suitable number of pull tabs other than the exemplary pair 210,212, could be employed, and that such pull tabs could be disposed at any suitable location on the shield member 202 other than the first and second ends 204,206, as shown and described herein.

The shield member 202 is preferably made from any known or suitable material which exhibits the desired characteristics of tear-resistance and sufficient resiliency (e.g., flexibility) to allow the shield member 202 to bend, as discussed hereinabove, while simultaneously being rigid enough to maintain its secure position on the panel assembly 124 throughout the coating process. The material must also resist tearing when it is removed following the coating process. Thus, it will preferably be reusable, in order to be cost effective. Two non-limiting examples of materials which exhibit the aforementioned desired properties include FORMEX™, which is available from FORMEX Manufacturing, Inc., 601 Hurricane Shoals Road, NW, Lawrenceville, Ga. 30045-7670, and MYLAR®, which is available from DuPont Teijin Films, 1 Discovery Drive, Hopewell, Va. 23860.

As best shown in FIG. 5B, the shield member 202 also has a thickness 238. In one, non-limiting example, such thickness 238 ranges from about 0.008 inch to about 0.02 inch.

Accordingly, the disclosed guard 200 provides an effective shield for preventing portions of an electrical enclosure including, for example, electrical components thereof, from being unintentionally coated (e.g., painted or otherwise covered by any known or suitable coating). The guard 200 is also readily employable for installation on a wide variety of electrical enclosures, is relatively low cost, and is reusable.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical enclosure comprising:

a housing structured to house a number of electrical components;

a panel assembly coupled to said housing and including a first side and a second side;

a first securing mechanism disposed at or about the first side of said panel assembly and being structured to receive and secure a number of electrical components;

a second securing mechanism disposed at or about the second side of said panel assembly, spaced a distance from said first securing mechanism and being structured to receive and secure a number of electrical components; and a guard comprising:

at least one shield member including a first end, a second end and an intermediate portion extending between the first end and the second end, and at least one pull tab disposed at or about a corresponding one of the first end of said at least one shield member and the second end of said at least one shield member, in order to facilitate removal of said at least one shield member from said panel assembly, wherein when at least one of said electrical enclosure and a structure proximate said electrical enclosure is being coated, said at least one shield member is installed on said panel assembly of said electrical enclosure in order to shield said panel assembly and a number of electrical components housed by said housing of said electrical enclosure from being undesirably coated, wherein when said at least one shield member is not installed on said panel assembly, said at least one shield member is substantially flat and includes a width which is greater than the distance between said first securing mechanism of said panel assembly and said second securing mechanism of said panel assembly, and wherein when said at least one shield member is installed on said panel assembly, the first end of said at least one shield member and the second end of said at least one shield member engage said first securing mechanism and said second securing mechanism of the first side and the second side of said panel assembly, respectively, resulting in the intermediate portion of said at least one shield member forming a protective arc which overlays and shields at least some of said electrical components housed by said housing of said electrical enclosure.

2. The electrical enclosure of claim 1 wherein said at least one pull tab comprises a first pull tab disposed at or about the first end of said at least one shield member, and a second pull tab disposed at or about the second end of said at least one shield member.

3. The electrical enclosure of claim 1 wherein said at least one shield member comprises one of: (a) a plurality of separate shield members installed on said panel assembly at locations where shielding from unintentional coating is desired, and (b) one single-piece shield member which shields and protects substantially all of said panel assembly.

4. The electrical enclosure of claim 1 wherein said panel assembly comprises a panel member and first and second electrical bus bars coupled to said panel member proximate said first securing mechanism and said second securing mechanism, respectively; wherein when said at least one shield member is installed on said panel assembly of said electrical enclosure, said at least one shield member comprises a first bend between the first end of said at least one shield member and said protective arc of said at least one shield member, and a second bend between the second end of said at least one shield member and said protective arc of said at least one shield member; and wherein said first bend and said second bend are disposed between said first and second electrical bus bars and a corresponding portion of said panel member, respectively, thereby securing said at least one shield member to said panel assembly.

5. The electrical enclosure of claim 4 wherein said at least one shield member includes an interior surface structured to face toward at least some of said electrical components of said electrical enclosure, and an exterior surface generally opposite said interior surface; and wherein said at least one shield member further comprises a first score in at least one of said interior surface of said at least one shield member and said exterior surface of said at least one shield member and a second score in at least one of said interior surface of said at least one shield member and said exterior surface of said at least one shield member, in order to facilitate bending of said at least one shield member to form said first bend and said second bend, respectively.

6. The electrical enclosure of claim 4 wherein a first portion of said at least one shield member between said first bend of said at least one shield member and the first end of said at least one shield member doubles back on itself, thereby comprising a first double thickness; wherein a second portion of said at least one shield member between said second bend of said at least one shield member and the second end of said at least one shield member doubles back on itself, thereby comprising a second double thickness; wherein said first double thickness of said first portion of said at least one shield member biases the first end of said at least one shield member generally outward in opposite directions, toward said panel member of said panel assembly and toward said first electrical bus bar of said first and second electrical bus bars of said panel assembly, respectively, in order to secure the first end of said at least one shield member therebetween; and wherein said second double thickness of said second portion of said at least one shield member biases the second end of said at least one shield member generally outward in opposite directions, toward said panel member of said panel assembly and toward said second electrical bus bar of said first and second electrical bus bars of said panel assembly, respectively, in order to secure the second end of said at least one shield member therebetween.

7. The electrical enclosure of claim 1 wherein said first securing mechanism and said second securing mechanism are a first plurality of teeth extending from the first side of said panel assembly, and a second plurality of teeth extending from the second side of said panel assembly, respectively; and wherein when said at least one shield member is installed on said panel assembly of said electrical enclosure, the first end of said at least one shield member and the second end of said at least one shield member engage said first plurality of teeth of said panel assembly and said second plurality of teeth of said panel assembly, respectively.

8. The electrical enclosure of claim 7 wherein said at least one pull tab of said guard comprises an extension of said corresponding one of the first end and the second end of said at least one shield member.

9. The electrical enclosure of claim 8 wherein when said at least one shield member is installed on said panel assembly, said extension extends from said corresponding one of the first end of said at least one shield member and the second end of said at least one shield member between an adjacent pair of said teeth of a corresponding one of the first side of said panel assembly and the second side of said panel assembly.

10. The electrical enclosure of claim 8 wherein said extension and said at least one shield member are one continuous piece of material.

11. A guard for an electrical enclosure including a housing, a number of electrical components housed by said housing, and a panel assembly coupled to said housing and including a first side and a second side, said panel assembly including a first securing mechanism disposed at or about the first side of said panel assembly and being structured to receive and secure a number of electrical components and a second securing mechanism disposed at or about the second side of said panel assembly, spaced a distance from said first securing mechanism and being structured to receive and secure a number of electrical components, said guard comprising:

a shield member including a first end structured to be coupled to said first securing mechanism of said panel assembly, a second end structured to be coupled to said second securing mechanism of said panel assembly, and an intermediate portion extending between the first end of said shield member and the second end of said shield member; and at least one pull tab disposed at or about a corresponding one of the first end of said shield member and the second end of said shield member, in order to facilitate removal of said shield member from said panel assembly, wherein said shield member is structured to be installed on said panel assembly of said electrical enclosure in order to shield said panel assembly and a number of electrical components housed by said housing of said electrical enclosure from being undesirably coated when at least one of said electrical enclosure and a structure proximate said electrical enclosure is being coated, wherein when said shield member is not installed on said panel assembly said shield member is substantially flat and includes a width which is greater than the distance between said first securing mechanism of said panel assembly and said second securing mechanism of said panel assembly, and wherein when said shield member is installed on said panel assembly, the first end of said shield member and the second end of said shield member are structured to engage said first securing mechanism and said second securing mechanism of the first side and the second side of said panel assembly, respectively, resulting in the intermediate portion of said shield member forming a protective arc which overlays and shields at least some of said electrical components housed by said housing of said electrical enclosure.

12. The guard of claim 11 wherein said at least one pull tab comprises an extension of said shield member; and wherein said extension and said shield member are one continuous piece of material.

13. The guard of claim 11 wherein said shield member is made from a tear-resistant material.

14. The guard of claim 11 wherein said shield member has a thickness; and wherein the thickness of said shield member ranges from about 0.008 inch to about 0.02 inch.

15. The guard of claim 11 wherein when said shield member is installed on said panel assembly of said electrical enclosure, said shield member further comprises a first bend between the first end of said shield member and said protective arc of said shield member and a second bend between the second end of said shield member and said protective arc of said shield member; and wherein said first bend and said second bend are structured to be disposed at or about said first securing mechanism of said panel assembly and said second securing mechanism of said panel assembly, respectively.

16. The guard of claim 15 wherein said shield member includes an interior surface structured to face toward at least some of said electrical components of said electrical enclosure, and an exterior surface generally opposite said interior surface; and wherein said shield member further comprises a first score in at least one of said interior surface of said shield member and said exterior surface of said shield member and a second score in at least one of said interior surface of said shield member and said exterior surface of said shield member, in order to facilitate bending of said shield member to form said first bend and said second bend thereof, respectively.

17. The guard of claim 15 wherein a first portion of said shield member between said first bend of said shield member and the first end of said shield member doubles back on itself, thereby comprising a first double thickness; wherein a second portion of said shield member between said second bend of said shield member and the second end of said shield member doubles back on itself, thereby comprising a second double thickness; wherein said first double thickness of said first portion of said shield member biases the first end of said shield member generally outward in opposite directions, in order to secure the first end of said shield member to said panel assembly and said first securing mechanism; and wherein said second double thickness of said second portion of said shield member biases the second end of said shield member generally outward in opposite directions, in order to secure the second end of said shield member to said panel assembly and said second securing mechanism.

18. The guard of claim 11 wherein said at least one pull tab comprises a first pull tab disposed at or about the first end of said shield member, and a second pull tab disposed at or about the second end of said shield member.

19. The guard of claim 18 wherein said at least one pull tab comprises an extension of said shield member; and wherein said extension and said shield member are one continuous piece of material.

20. The guard of claim 19 wherein said shield member is made from a tear-resistant material.

21. A guard for an electrical enclosure including a housing, a number of electrical components housed by said housing, and a panel assembly coupled to said housing and including a first side and a second side, said panel assembly including a first securing mechanism disposed at or about the first side of said panel assembly and being structured to receive and secure a number of electrical components and a second securing mechanism disposed at or about the second side of said panel assembly, spaced a distance from said first securing mechanism and being structured to receive and secure a number of electrical components, said guard comprising:

a shield member including a first end structured to be coupled to said first securing mechanism of said panel assembly, a second end structured to be coupled to said second securing mechanism of said panel assembly, and an intermediate portion extending between the first end of said shield member and the second end of said shield member; and at least one pull tab disposed at or about a corresponding one of the first end of said shield member and the second end of said shield member, in order to facilitate removal of said shield member from said panel assembly, wherein said shield member is structured to be installed on said panel assembly of said electrical enclosure in order to shield said panel assembly and a number of electrical components housed by said housing of said electrical enclosure, wherein when said shield member is not installed on said panel assembly said shield member is substantially flat and includes a width which is greater than the distance between said first securing mechanism of said panel assembly and said second securing mechanism of said panel assembly, and wherein when said shield member is installed on said panel assembly, the first end of said shield member and the second end of said shield member are structured to engage said first securing mechanism and said second securing mechanism of the first side and the second side of said panel assembly, respectively, resulting in the intermediate portion of said shield member forming a protective arc which overlays and shields at least some of said electrical components housed by said housing of said electrical enclosure.

* * * * *